United States Patent [19]

Lewis

[11] 4,158,793

[45] Jun. 19, 1979

[54] GAS DISCHARGE LAMP CONTROL CIRCUIT

[76] Inventor: Gary D. Lewis, 22325 Bon Heur, St. Clairs Shores, Mich. 48081

[21] Appl. No.: 814,383

[22] Filed: Jul. 11, 1977

[51] Int. Cl.[2] ..... H05B 41/30; H05B 41/392

[52] U.S. Cl. ..... 315/101; 315/102; 315/105; 315/106; 315/107; 315/171; 315/172; 315/174; 315/176; 315/205; 315/209 R; 315/DIG. 5; 315/DIG. 7

[58] Field of Search ..... 315/DIG. 7, 101, 102, 315/105, 106, 107, 171, 172, 174, 175, 176, 205, 208, 209 R, DIG. 5, 98

[56] References Cited

U.S. PATENT DOCUMENTS

| | | | |
|---|---|---|---|
| 2,668,259 | 2/1954 | Stutsman | 315/205 X |
| 2,697,801 | 12/1954 | Hamilton | 315/107 X |
| 2,810,862 | 10/1957 | Smith | 315/205 X |
| 2,961,579 | 11/1960 | Roney et al. | 315/174 X |
| 3,638,070 | 1/1972 | Powell | 315/170 X |
| 3,720,861 | 3/1973 | Kahanic | 315/107 X |
| 3,753,040 | 8/1973 | Quenelle | 315/DIG. 7 |

*Primary Examiner*—Alfred E. Smith
*Assistant Examiner*—Charles F. Roberts

[57] ABSTRACT

An energizing circuit for gas discharge lamps for room or street lighting or for lights used in document copying machines and the like comprises means for continuously energizing the same at a low non-useful light producing level when such lamps are not needed by a voltage which strikes an arc and maintains a low level of ionization with an infinitesimally small current and very little energy drain. This voltage may be an AC voltage or a DC voltage supplied by a unique circuit including a number of DC voltage sources, rectifiers, voltage adjusting and current-limiting impedances and electronic switches. The lamps are energized by AC or pulsating DC supplied by the aforesaid or other electronic switches operated at a high frequency of at least about 20–30 kilo-Hertz. When pulsating DC is utilized and the switches are rendered conductive, back-biasing voltages are applied to rectifiers which disconnect one of the voltage sources and re-connect the same or another voltage source to a different terminal of the lamps which causes an increase in the current flow in the lamps, resulting in a high degree of ionization to cause the lamps to emit substantial light. High operating lamp efficiency is achieved by modulating the electronic switches at said high frequency rate and de-energizing all heater windings during normal lamp energization.

14 Claims, 4 Drawing Figures

GAS DISCHARGE LAMP CONTROL CIRCUIT

BACKGROUND OF THE INVENTION

The present invention relates to control circuits for gas discharge lamps, such as fluorescent lamps commonly used for room illumination, and also for gas discharge lamps used in document copying machines, street lighting and the like.

While the life and efficiency of gas discharge lamps used for street and room illumination greatly exceed that for incandescent lamps, there is still room for significant improvement therein. It has been recognized that the life of gas discharge lamps like fluorescent lamps is determined, in part, by the number of times such devices are turned on and off. Thus, it is thought that the initial striking of an arc in the gases of such a device may sputter-deposit mercury or other gas elements upon the fluorescent coating of such lamps, which progressively deteriorates the same. It has, therefore, been suggested to utilize room lighting fluorescent lamps by keeping such lamps on continuously in buildings even when they are not in use. Obvious disadvantages of this suggestion are waste of energy and the sometimes bothersome illumination from such buildings to occupants of adjacent buildings. Accordingly, one of the subjects of the present invention is to provide a unique mode of operation of gas discharge lamps like fluorescent lamps and the like which increases the life thereof without the disadvantages inherent in leaving the lamps continuously in an on condition.

The life of gas discharge lamps used in document copying machines has particularly left much to be desired. Generally, these lamps are provided with heaters at opposite ends thereof which are continuously energized. The current required by such lamps is generally much greater than that required for gas discharge lamps used for room illumination and, therefore, the damage caused by the repeated striking of arcs within these devices is materially greater than present in the lower current rated devices used for room illumination. Accordingly, the life of gas discharge lamps used in document copying machines which are repeatedly energized is especially undesirably short. It is, therefore, another object of this invention to produce a unique mode of operation of gas discharge lamp devices used in document copying and other machines requiring repeated momentary energization thereof which materially increases the life thereof.

A further object of the invention is to provide a unique energizing circuit for gas discharge lamps which substantially increases the efficiency of such energizing circuits over those heretofore used.

SUMMARY OF INVENTION

It has been discovered that an arc can be struck in gas discharge lamps and a low level of ionization maintained at very low currents which do not effect lighting of these lamps, and wherein lighting of the lamps is achieved without requiring any further arc-initiation by increasing the current therein above a threshold level causing full energization thereof when turn-on of the lamp is desired. Thus, in accordance with one of the features of the present invention, where desired for both room and street illumination and especially for document copying machine applications, the gas discharge lamps used therein when not in normal use are continuously energized at a very low, non-useful light producing level, so as to minimize energy loss and to avoid the necessity of striking an arc each time the lamps are to be fully ionized to a degree which causes substantial light emission and current drain. Such low level stand-by energization of the lamps has the added advantage in document copying machines that the lamps reach their maximum light intensity instantaneously, unlike conventional energizing procedures where the lamps slowly reach their peak intensity. Also, in this application of the invention, where the lamps heretofore have usually been operated on and off hundreds if not thousands of times each day, this lamp life-increasing aspect of the invention has especial importance.

Fluorescent lamps come in a variety of different types, some of which have and some of which do not have heater windings. The rapid start type of lamp which is considered the most efficient of all of the different types of fluorescent lamps is generally energized by 60 Hertz AC current and is provided with heater windings at opposite ends thereof which are continuously energized to aid in striking an arc and maintaining ionization therein every half cycle of the 60 Hertz current. These heater windings are generally operated at current levels which consume approximately about 20 percent of the power used when the lamps are fully energized. When the aforesaid continuous low-level stand-by energizing of the lamps is utilized, it would be desirable to save energy by de-energizing the heater windings. For certain ideal conditions, this may be feasible. However, because the heater windings utilize only a small percentage of the power consumed by the fluorescent lamps each day, if the reliable maintenance of the low level ionization so requires, the heater windings thereof should be continuously energized during standby lamp operation.

The use of heater windings has been considered an important factor contributing to the efficiency of rapid start fluorescent lamps. As disclosed in U.S. Pat. No. 4,009,412 and many expired patents, a substantial increase in operating efficiency can be achieved in the normal operation of rapid start fluorescent lamps and the like by eliminating completely the energization of the heater windings during normal operation thereof. In accordance with another aspect of the invention, the heater windings are utilized only to strike an arc and initiate a low level of gas ionization of the gas therein at reasonable applied voltage levels, and to maintain such low level of gas ionization where the life-increasing mode of operation of the fluorescent lamps previously described is utilized. In either case, when the fluorescent lamp is to be fully energized, the heater windings are completely deenergized to save the energy previously used to energize the same.

The published literature has frowned on the use of DC and suggested utilizing high frequency AC voltage source to energize flourescent lamps to increase operating efficiency and reduce the size of inductive ballast devices used therewith. In accordance with still another feature of the invention, fluorescent lamps used in copying machines and the like are energized with pulsating DC at pulse repetitious rates preferably between 20–30 kilo-Hertz. It has been found that the convenience of DC current control circuits outweighs any disadvantages of DC used to energize flourescent lamps when the lamps are operated for only short instants of time.

In accordance with another feature of the present invention, during the time the heater windings are used in rapid-start fluorescent lamps or the like, such as during the stand-by low level gas ionizing mode of operation thereof previously described, only one of the heater windings of each fluorescent lamp is energized. In such case, the voltages used to operate the lamp during at least the operation of the heater winding is a DC voltage connected to the terminals of the lamp, so that the terminal at the end of the lamp having the unenergized heater winding is positive relative to the terminal at the end of the lamp having the energized heater winding and electrons generated by the energized heater winding are drawn to the lamp electrode at the opposite end of the lamp. The energy saved by using only one heater winding makes more feasible the use of heater windings continuously even during the low-level energization thereof when the lamp is in stand-by operation.

In accordance with a still further feature of the present invention, when DC is used to operate the gas discharge lamps, the use of inductive ballast devices is eliminated by a unique combination of high frequency pulsating DC voltage sources connected to the lamp terminals to create two different applied voltage conditions for operating the gas discharge lamps involved in the manner described, namely an initial low level ionization producing voltage condition which effects said low level of gas ionization, and a high level ionization producing voltage condition where the current is increased above a threshold level to fully ionize the gas to turn the lamp on. The low level ionizing voltage condition is most advantageously obtained by rectifying the 60 Hertz AC power line voltage of the desired level, using a step-up transformer where necessary, and the high level ionization producing condition is supplied by a relatively low DC voltage source preferably pulsed at a pulse repetition rate many orders greater than 60 Hertz power line frequency, such as a frequency of at least about 20–30 kilo-Hertz. Such high frequency operation of the lamp greatly increase the operating efficiency relative to its operation with conventional 60 Hertz frequency current. These voltage conditions can be most effectively produced by connecting a first relatively high DC starting voltage source and a relatively large voltage dropping impedance in a series circuit including only said starting voltage source and the lamp terminals, a second lower DC low level ionization producing voltage source having a terminal connected through a rectifier to the same lamp terminal as is the terminal of the corresponding polarity of said first voltage source. In such a circuit, said rectifier is automatically forwardly biased and back-biased in the proper sequence to operate the lamps as previously described.

It was unexpectedly discovered that substantial further improvements in operating efficiency are achieved by removing the high DC starting voltage source completely from the circuit, as by opening the connections of the circuit thereto so that no current can flow therefrom. By eliminating energization of all heater windings during full energization of rapid-start flourescent lamps or the like, utilizing a high frequency sustaining voltage and disconnecting the aforementioned high DC starting voltage source, a savings of up to 40% in power requirements has been achieved in comparison to what was previously believed to be the most highly efficient rapid-start flourescent lighting systems using inductive ballast devices.

The above described and other objects, advantages and features of the invention will become more apparent upon making reference to the specification to follow, the drawings and the claims.

DESCRIPTION OF EXEMPLARY FORMS OF THE INVENTION

Figure 1:
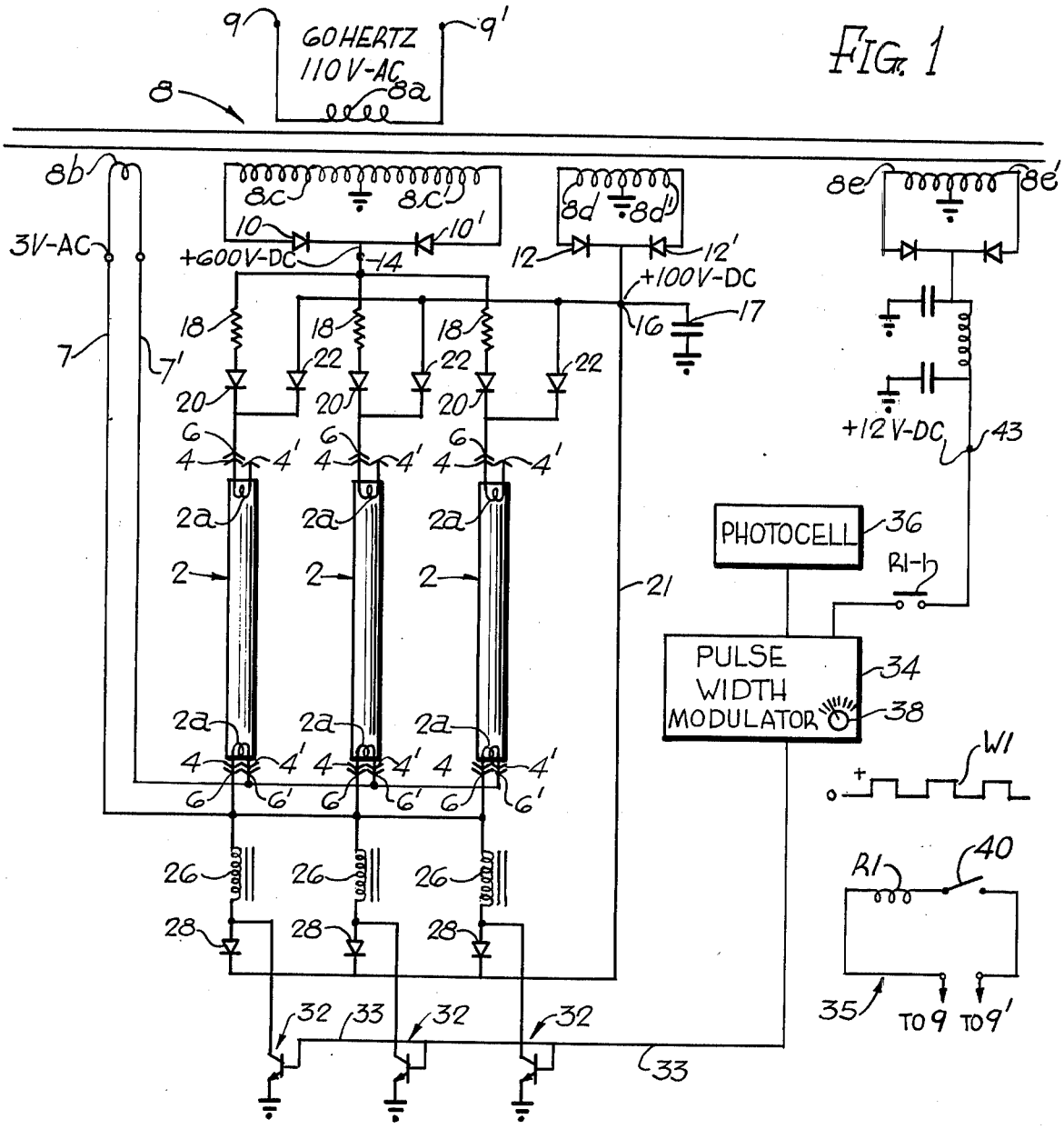
FIG. 1 is a circuit diagram showing the energization circuit of the present invention applied to control fluorescent lamps used for room illumination.

FIG. 1 illustrates the application of the invention for controlling the energization of a rapid-start type of fluorescent lamp, which is considered the most efficient type of fluorescent lamp. Fluorescent lamps have an elongated glass cylindrical tube containing a mercury vapor which, when ionized to a high degree, generates ultraviolet light which excites the coating of the inner surface of the tube. To ionize the vapor, an arc must be struck within the gas with the application of a voltage of sufficient magnitude to cause initiation of an arc discharge which is aided by the generation of electrons by a heated filament. The rapid start fluorescent lamps 2 in FIG. 1 have a heater winding **2*a* at each end thereof connected to respective terminals 4—4'. In the preferred form of the invention, heater current is fed to only one of the windings. To this end, the terminal 4 at the upper end of the lamp as shown in FIG. 1 is connected to a connecting terminal 6 of the energizing circuit of the invention, and the other terminal 4' is shown unconnected to any circuit terminal. The ends of the heater winding 2*a* at the opposite end of each lamp are shown connected to connecting terminals 6—6' of the energizing circuit of the invention which terminals are connected through conductors 7—7' to a source of heating current, shown as the secondary winding 8*b* of a power transformer 8 whose primary winding 8*a* extends to terminals 9—9'** of a source of 110 volts 60 Hertz AC.

As previously indicated, it has been discovered that an arc can be struck and maintained within a fluorescent lamp or other gas discharge lamp without any substantial current drain being involved, to produce a very low level of sustained ionization which involves little current drain and does not sufficiently excite the phosphor in the lamp to light the same. Therefore, to avoid repeated starting of the lamps 2 which limits its life, in accordance with one of the features of the invention, the fluorescent lamps 2 are continuously energized at a very low level. To this end, as previously described, means are provided for feeding a low ionization level producing voltage across the terminals 4—4 of each lamp 2 through the connecting terminals 6—6 at the opposite ends thereof when the lamps would normally be turned off. This low ionization level producing voltage can be applied to the lamp in a number of different ways, one exemplary way being in the manner now to be described.

In FIG. 1, a power transformer 8 is shown having a center-tapped secondary winding with sections **8*c*—8*c*' whose outer ends are connected through rectifiers 10—10' to produce at a terminal 14** 600 volts (rms) of pulsating DC voltage. (The exemplary voltage conditions being described were utilized with a 110 volt, 300 milliamp rated rapid-start fluorescent lamp.) A source of much lower DC voltage like 100 volts (rms) of pulsating DC voltage is obtained from a secondary winding of the transformer 8 having a grounded center tap on opposite sides of winding sections **8*d*—8*d*'. Rectifiers 12—12' are connected from the outer ends of these winding sections to a terminal 16. A filter capacitor 17 connected between terminal 16 and ground reduces the output supply to an acceptable level. A low level gas ionization producing voltage is obtained by connecting the 600 volts DC at the terminal 14 in opposition to the 100 volts DC and the terminal 16 to produce a net of about 500 volts which is sufficient to start and sustain a low level of ionization. As previously indicated, the turn-on of the lamps 2 is achieved by shorting out the voltage at the terminal 16** from one of the terminals of each lamp and connecting it to the other terminals of each lamp where it raises the current flow through the lamps above the aforementioned threshold level.

To this end, the 600 volt terminal 14 is connected to the various lamp connecting terminals 6 at one end of the lamps 2 through individual branch circuits each including a relatively large value resistor 18 (e.g. 470,000 ohms) and a rectifier 20, and the 100 volt terminal 16 is connected to the various lamp connecting terminals at the other end of the lamps 2 by a line 21 through individual branch circuits each including a rectifier 28 and a current-limiting inductor 26 (e.g. 50–75 ohms at a frequency of 20–30 kilo-Hertz). Of course, the rectifiers 20 and 28 must be arranged in the circuit to permit current to flow in the same direction through the circuit including each of the lamps 2. Each large resistor 18 reduces current flow through the associated lamp to an infinitesimal value, like about 1 milliamp or less. It should be further noted that the terminal 4 of each lamp which is positive with respect to the terminal 4 at the opposite end of the lamp is associated with the heater winding **2*a* which is not energized, so that the electrons generated by the other heater winding 2*a*** which is energized flows in an arc-aiding direction through the lamps. If the energized heater winding of a lamp should become damaged or wear out, the lamp can be operable by merely reversing the connections of the lamps in the circuit shown.

The plus 100 volt terminal 16 is also connected to the junction of each rectifier 20 and the adjacent connecting terminal 6 through individual rectifiers 22. The voltage at these junction points is initially above 100 volts so that rectifiers 22 are back-biased to a non-conductive condition.

Figure 2:
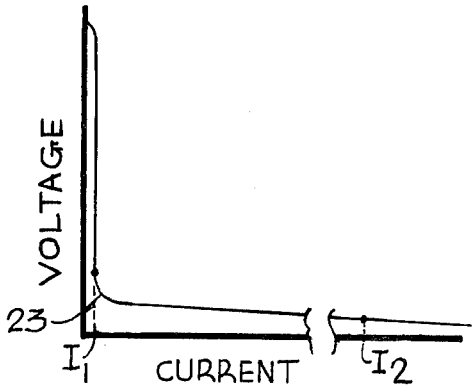
FIG. 2 shows a typical voltage-current waveform of a fluorescent lamp.

FIG. 2 shows a typical voltage-current characteristic of a fluorescent lamp and shows that during a low level energization of the lamps 2 they are in a condition where current is at a very low level, like 1 milliamp or a small fraction thereof represented by current value I1. When the current in the tube is raised above a threshold level which is indicated by the knee point 23 on the curve shown in FIG. 2, the current suddenly increases to a very substantial value measured in hundreds of milliamps like value I2, to cause a high degree of ionization to effect light producing exitation of the lamp phosphor.

Turn-on of the lamps is achieved by grounding the junction of each of the inductors 26 and rectifiers 28 through a switch shown as a NPN transistor 32 having its collector connected to the latter junction, a grounded emitter, and a base connected by a conductor 33 to the output of a pulse width modulator circuit 34. The reason why 500 volts is applied to the lamps initially by subtracting 100 volts from 600 volts in the manner described is because then the rectifiers 28 isolate the transistors 32 from the needed 500 volt arc-initiating source, since the collector connected sides of the rectifiers cannot rise above 100 volts. A control circuit 35 is provided including a relay R1 in series with a lamp on-off switch 40 connected in series across the 60 volt AC terminals 9—9'. When relay R1 is energized by the closure of the switch 40, plus 12 volts DC is coupled from a terminal 43 through normally open contacts R1-1 of the relay R1 to a more or less conventional pulse width modulator dimming circuit 34 which then produces on conductor 33 a square wave output W1, alternately varying between 0 and a positive value, for alternately opening and closing the transistor switches 32 at a high frequency rate, which is greatly in excess of the 60 Hertz power line frequency, such as a frequency of at least about 20–30 kilo-Hertz. In such a dimming circuit, the duty cycle or duration of the positive portion of each cycle of the wave form W1 is variable. (The plus 12 volt voltage on terminal 43 may be the filtered output from a full wave rectified voltage obtained from a secondary winding 8e—8é of transformer 8.) As is conventional with most pulse width modulator circuits, there is provided a manually operable control 38 which establishes a desired normal duty cycle of the output thereof. Also, to maximize efficiency of the room illumination system involved, a photocell 36 is shown which responds to the light output of the lamps 2 and is connected to the pulse width modulator circuit to vary the duty cycle thereof in accordance with the artificial light needs of the particular room involved.

Each time the voltage applied to the base of a transistor 32 is fed with a positive portion of wave form W1, the transsistor is rendered conductive to couple ground potential to the junction of each associated rectifier 28 and inductor 26, which causes a back-biasing of each rectifier 28 to de-couple the 100 volt DC voltage from the bottom terminal 4 of each lamp 2 as viewed in FIG. 1. The voltage at the junction of each pair of connected rectifiers 20–22 then drops below plus 100 volts so that rectifiers 22 become conductive to couple the plus 100 volts on terminal 16 to each lamp which, because of the low impedance of the inductors 26, result in the raising of the current through the lamps above the aforementioned threshold voltage level, to switch these lamps into a highly ionized condition which effects light-producing exitation of the lamps. The inductors 26 act as current-limiting resistors for the current flowing during the high level ionization of the lamps. The 100 volt voltage and current coupled through the rectifiers 22 becomes the energizing voltage and current for the lamps. In FIG. 1, the 600 volts is not de-coupled from the lamps 2 and it continues to supply a small current. The wave form of the voltage across the lamp terminals and inductors as viewed on an oscilloscope show that the voltage is a low voltage of about 40–50 volts with a slight ripple thereon, and the current is a fairly steady DC current with a slight ripple therein.

Figure 3:
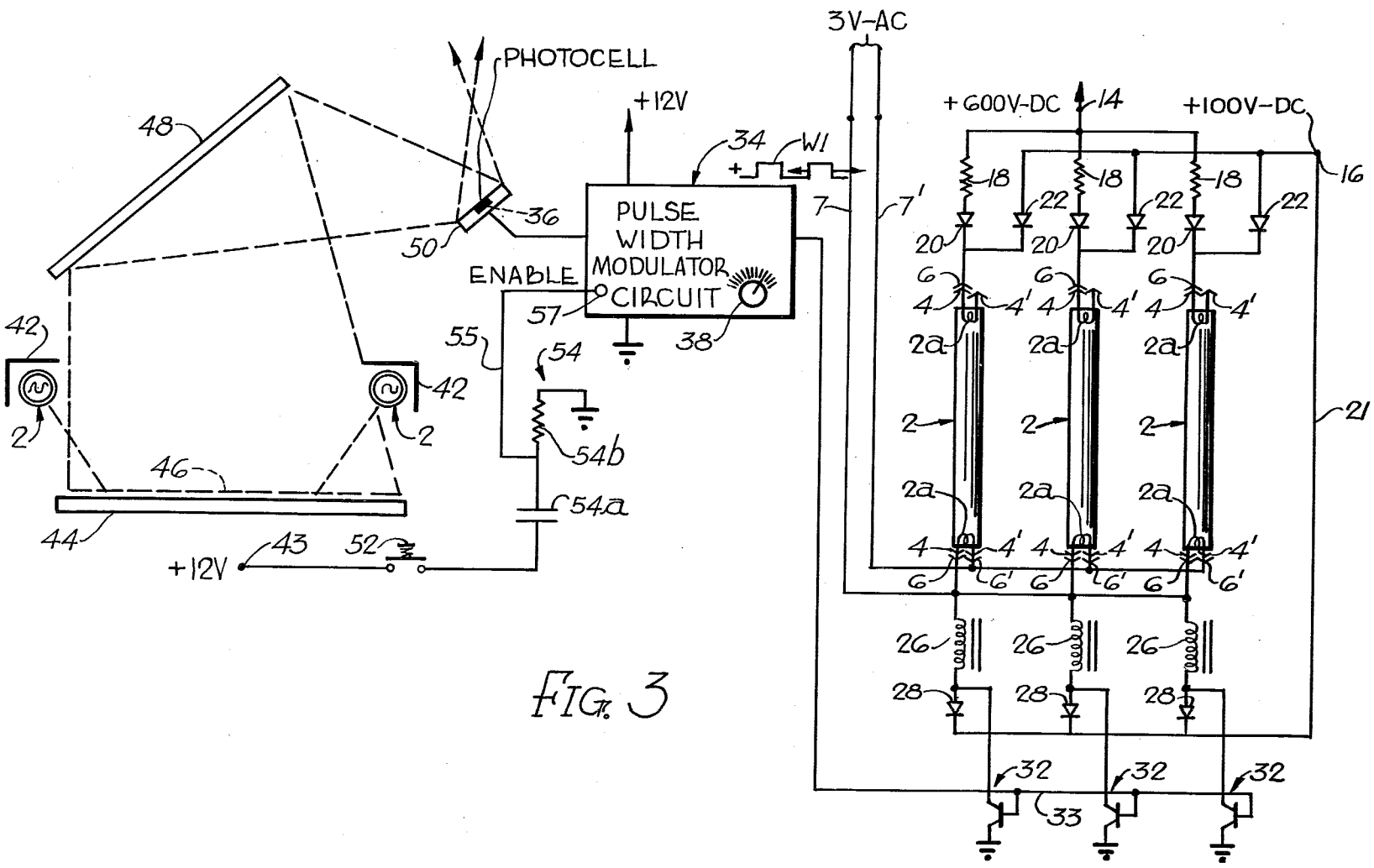
FIG. 3 shows the energizing circuit of the present invention applied to control the energization of fluorescent lamps in a document copying machine.

Reference should now be made to FIG. 3 which shows the application of the present invention to a document copying machine. As there shown, fluorescent lamps 2—2 are associated with reflectors 42—42 for reflecting light upon a document 46 placed upon a platform 44. The light reflecting off of this document is directed to a first mirror 48 and then to a second mirror 50 where it is then directed to other portions of the machine (not shown). The aforementioned photocell 36 shown in FIG. 1 is here shown positioned to intercept the reflected light from the document 46 so that the fluorescent lamps 2 are energized to a degree depending upon the lighting needs involved, to provide ideal document copies. While the photocell 36 may be placed in any suitable position, it is shown associated with the mirror 50. A conductor 51 connects the photocell 36 to the pulse width modulator 34. Unlike the room illumination application of the present invention shown in FIG. 1, the fluorescent lamps 2 are only fully energized momentarily each time it is desired to make a copy of the document involved. To this end, a push-button switch 52 is shown connected between the +12 volt terminal 43 and a differentiating network 54 comprising a capacitor **54*a* and a resistor 54*b* connected in series to ground. It is apparent that each time the switch 52 is closed, a positive pulse of voltage will appear across the resistor 54*b* independently of the length of time the switch 52 is closed. This positive pulse is coupled by a conductor 55 to an enabling input terminal 57 of the pulse width modulator circuit 34. Commercially available pulse width modulator circuits have such an enabling input terminal which, when energized, has the same effect as the closure of the contacts R1-1 in the circuit of FIG. 1, namely to permit the pulse width modulator circuit to feed the high frequency wave form W1 voltage to the switches to be controlled thereby for the duration of each positive pulse. The fluorescent lamps 2 in FIG. 3 are connected into an energizing circuit which is identical to that described in connection with FIG. 1 and thus need not now be described. (Reference numbers are shown in FIG. 3 for the various elements of the energizing circuit corresponding to those used in FIG. 1** for the same elements previously described.)

Figure 4:
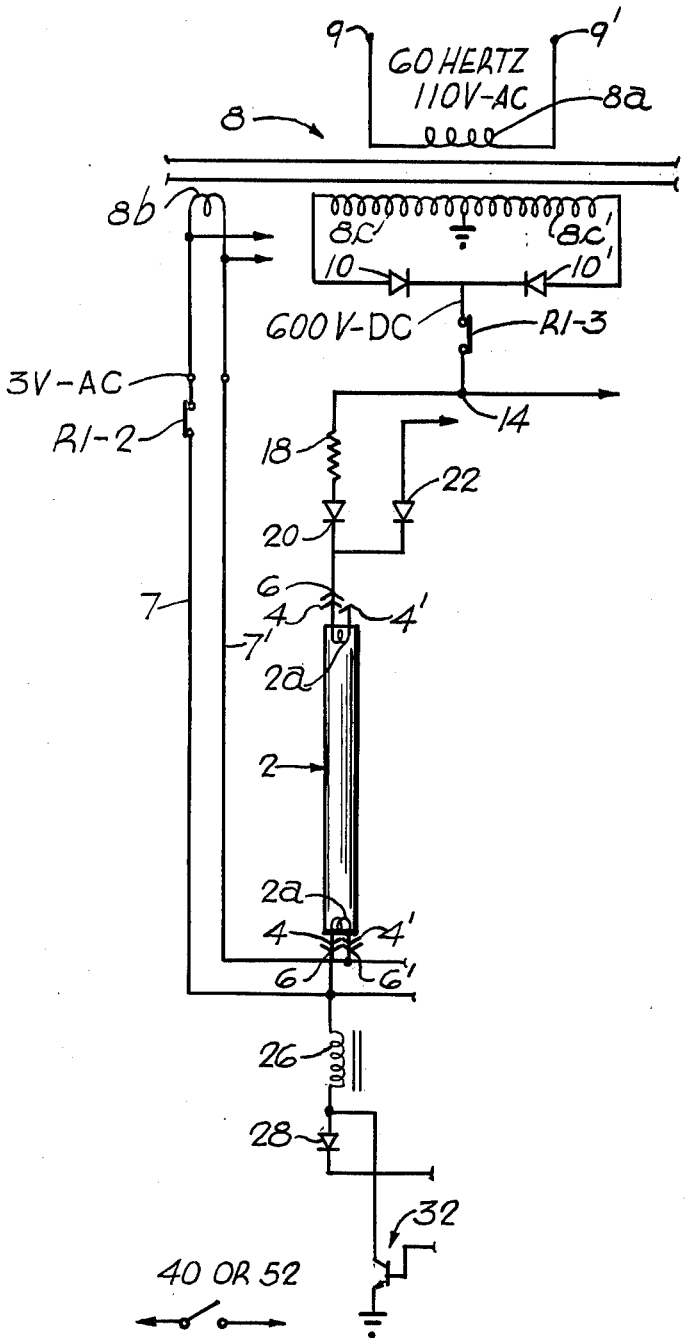
FIG. 4 shows a further improvement in the energization circuit of FIGS. 1 and 3.

It has been unexpectedly discovered that while it was previously believed that the energization of the heater windings of rapid-start fluorescent lamps and the like was necessary for maximum efficiency of operation thereof, the exact opposite is true. The energization of at least one heater winding in such lamps is necessary primarily as an aid in effecting the striking of an arc and the maintenance of a low level of ionization during the stand-by operating mode of the invention. Once such a low level of ionization is initiated, further energization of the heater winding is unnecessary and wasteful of energy. Thus, by de-energizing all heater windings during normal full energization of gas discharge lamps, like rapid start fluorescent lamps, saves as much as 20% in power over the normal use of such lamps when both heater windings were heretofore continuously energized. To this end, as shown in FIG. 4, a relay like relay R1 in FIG. 1 has a normally closed set of contacts R1-2 connected in series with the secondary winding **8*b* of transformer 8 so that contacts R1-2 are opened during the full energization of the lamps to de-energize the heater windings 2*a***.

While it was not believed initially that any appreciable energy loss took place during the full energization of the fluorescent lamps 2 in FIGS. 1 and 3 as a result of current flow in the 600 volt DC circuit when transistors 32 were non-conductive, it was found that significant energy savings are achieved by placing a set of normally closed contacts R1-3 (FIG. 4) in series with the 600 volt DC terminal 14 which open during the full energization of the lamps.

The present invention has thus provided an inexpensive and effective energizing control circuit for gas discharge lamps for room illumination, document copying machines and the like, wherein the life of the lamps and the efficiency of operation thereof is maximized.

It should be understood that numerous modifications may be made in the most preferred forms of the invention shown in the drawings, without deviating from the broader aspects of the present invention.

I claim:

1. A circuit for operating a gas discharge lamp having terminal means to which ionizing voltage sources are to be connected and which has a gas which ionizes at a very low non-light producing level when a relatively small amount of current is fed therethrough and which ionizes at a relatively high level to produce substantial visible light when current flow therethrough is raised above a given threshold level, said circuit comprising: a pair of gas discharge lamp connecting terminals to which said terminal means of said gas discharge lamp are to be connected, means for continuously applying a low level gas ionization producing current across said pair of connecting terminals when lamp turn-off is desired to effect the striking of an arc within the gas discharge lamp and the flow of a very low current below said threshold level to produce continuously said low degree of gas ionization, and manually operable lamp turn-on initiating and sustaining switch means for replacing the low level gas ionization producing current across said connecting terminals by a high level gas ionizing current above said threshold level, to produce said high level of gas ionization and the full light producing energization of the gas discharge lamp.

2. The gas discharge lamp energizing circuit of claim 1 wherein said high level gas ionizing current is produced by a pulsating source of voltage which pulsates at a frequency orders greater than 60 Hertz.

3. The gas discharge lamp energizing circuit of claim 2 wherein said high level gas ionizing current is produced by a pulsating source of DC voltage.

4. The gas discharge lamp energizing circuit of claim 1 wherein said low level gas ionization producing current is produced by a voltage obtained by the rectification of 60 Hertz AC voltage, and said high level gas ionizing current is produced by a pulsating DC voltage pulsating at frequency orders greater than 60 Hertz.

5. In a document copying machine or the like having one or more gas discharge lamps which is to be repeatedly momentarily operated, each of said lamps having a pair of terminal means to which ionizing voltage sources are to be connected and which has a gas which ionizes at a very low non-light producing level when a relatively small amount of current is fed therethrough and which ionizes at a relatively high level to produce substantial visible light when current flow therethrough is raised above a given threshold level, an energizing circuit for said lamps comprising stand-by operating means for normally continuously feeding a low level gas ionization producing current through each of said lamps when lamp turn-off is desired, to effect the striking of an arc within each gas discharge lamp and the flow of a very low current below said threshold level therethrough to produce continuously said low degree of gas ionization, and manually operable lamp turn-on initiating and sustaining switch means for replacing the low level gas ionization producing current in each lamp by a high level gas ionizing current above said threshold level, to produce said high level of gas ionization and the full light producing energization of the gas discharge lamp.

6. The document copying machine or the like of claim 5 wherein each gas discharge lamp has heater means therein for aiding in the establishment of an arc therein to effect said low level gas ionization, said energizing circuit having a source of heater current connected to the heater means of each lamp during standby operation thereof, and said lamp turn-on initiating and sustaining switch means including control means selectively operable to a lamp turn-on condition which effects the replacement of said low level gas ionization producing current by said high level gas ionizing current, and means responsive to the operation of said control means to said lamp turn-on condition for terminating the feeding of said heater voltage to said heater means of each lamp.

7. A circuit for operating a gas discharge lamp having a pair of terminal means to which voltage sources are to be connected and which has a gas which ionizes at a very low non-light producing level when a relatively small amount of current is fed therethrough and which ionizes at a relatively high level to produce substantial visible light when current flow therethrough is raised above a given threshold level, said circuit comprising: a pair of gas discharge lamp connecting terminals to which said terminal means of said gas discharge lamp are to be connected, first low level ionization producing voltage source means connected across said pair of gas discharge lamp connecting terminals through a relatively large impedance means which limits current flow to a value below said threshold level when turnoff of the lamp is desired, said low ionization level producing voltage source means producing a voltage for effecting the striking of an arc within the gas discharge lamp, and energizing voltage source means and a relatively low impedance means to be coupled in series across said pair of gas discharge lamp connecting terminals when it is desired to raise the current flow through said lamp above said threshold level and effect said light-producing high level gas ionization, and manually operable switch means operable to a lamp turn-on condition for coupling said energizing voltage source means and said relatively low current limiting impedance means across said connecting terminals to raise and sustain the current in the lamp above said threshold level.

8. The gas discharge lamp operating circuit of claim 7 wherein said low level gas ionization voltage source means comprises a first relatively high DC voltage source coupled between one of said gas discharge lamp connecting terminals and a common reference point and a second relatively low DC voltage source coupled between the other discharge lamp connecting terminal and said common reference point so that the second voltage source is in voltage opposing relationship to the first voltage source, and there is provided a first rectifier between said first voltage source and the gas discharge lamp connecting terminal to which it is connected, a second rectifier between said second voltage source and the gas discharge lamp connecting terminal to which it is connected, said rectifiers permitting current flow to and from the gas discharge lamp in the same direction, and a switch coupled between the terminal of said second rectifier closest to the latter connecting terminal of said common reference point so that the connection of said terminal of the rectifier to said common reference point effectively back-biases the same to disconnect said second voltage source from the latter connecting terminal when said switch is closed.

9. The gas discharge lamp operating circuit of claim 8 wherein said energizing voltage source means includes a third DC voltage source connected through a third rectifier to the connecting terminal to which said first voltage source is connected through the first rectifier similarly oriented with respect thereto, the DC voltage at said latter connecting terminal being above the output of said third voltage source to back-bias said third rectifier before said control means is operated to said lamp turn-on condition and being below said output when said control means is operated to said lamp turn-on condition.

10. The gas discharge lamp operating circuit of claim 9 wherein there is provided means responsive to the operation of said switch means to said lamp turn-on condition for opening the circuit which connects said first voltage source to the associated lamp connecting terminal.

11. The gas discharge lamp operating circuit of claim 7 for operating a gas discharge lamp having one or a pair of spaced heater means positioned adjacent to said pair of lamp terminal means for directing electrons into the lamp therein to aid in the striking of an arc therein, and one or two pairs of heater voltage applying terminals for applying heater voltage respectively to said heater means, said low level ionization producing voltage source means being a source of DC voltage, said circuit further including heater voltage connecting terminals for energizing only one pair of heater voltage applying terminals of said gas discharge lamp, a source of heater voltage initially connected to said heater voltage connecting terminals associated with only one pair of lamp heater voltage applying terminals continuously to energize the same, there being no operative connections of any source of heater voltage to any other heater voltage connecting terminals so that only one heater means of the lamp is energized, and said source of DC voltage being connected to said energizing voltage connecting terminals so that the energizing voltage connecting terminal associated with the energized heater means is negative with respect to the energizing voltage connecting terminal associated with any unenergized heater means.

12. The circuit of claim 1 for operating a gas discharge lamp having heater means for directing electrons into the lamp to aid in the striking of an arc, and heater voltage receiving terminals for receiving heater voltage for said heater means, said circuit further comprising: heater voltage connecting terminals to which said heater voltage receiving terminals of said gas discharge lamp are respectively to be connected, a source of heater voltage initially connected to said heater voltage connecting terminals to aid in the striking of said arc, and said lamp turn-on initiating and sustaining switch means including means for disconnecting said heater voltage source from said heater voltage connecting terminal means after said arc is struck in the lamp.

13. The gas discharge lamp operating circuit of claim 12 combined with said gas discharge lamp of the rapid-start fluorescent type which has its heater voltage applying and ionizing voltage applying terminals thereof respectively connected to the heater voltage and ionizing voltage applying connecting terminals of said circuit.

14. A circuit for operating a gas discharge lamp having a pair of terminals to which starting and energizing voltage source are to be connected, said circuit comprising: a pair of gas discharge lamp connecting terminals to which said terminals of said gas discharge lamp are to be connected, a starting voltage source having a pair of output terminals across which a relatively high DC voltage appears of a value to initiate the striking of an arc within said gas discharge lamp to be connected across said lamp connecting terminals, means for coupling said output terminals of such starting voltage source through a relatively high impedance across one of said gas discharge lamp connecting terminals and a common reference point, means for connecting the other lamp connecting terminal to said common reference point, a source of energizing voltage having a pair of output terminals across which appears a relatively low lamp current-sustaining DC voltage, means for coupling said output terminals of said energizing voltage source through a relatively low impedance across said one lamp connecting terminal and said common reference point, there being a rectifier interposed in current passing relation in the path of current flow between said one lamp connecting terminal and said source of energizing voltage, the output terminals of said starting and energizing voltage sources connected to said one gas discharge lamp connecting terminal being of the same polarity, the DC voltage appearing at said one lamp connecting terminal being initially above the DC voltage coupled to said rectifier from said energizing voltage source so that the rectifier is initially back-biased, and when current starts to flow through said relatively high impedance to the lamp the voltage drop occurring across said relatively high impedance reducing the voltage in the circuit to cause said rectifier to be forwardly biased by the DC voltage coupled thereto from the adjacent output terminal of said source of energizing voltage, to cause light-producing sustaining current to flow in said lamp.

* * * * *